US007977293B1

(12) United States Patent
Locante

(10) Patent No.: US 7,977,293 B1
(45) Date of Patent: Jul. 12, 2011

(54) VOLATILE CLEANING SOLUTION FOR FRAGILE OBJECTS AND METHOD OF USE

(75) Inventor: Steven Locante, Lake Worth, FL (US)

(73) Assignee: Palm Beach Lighting LLC, West Palm Beach, FL (US)

( * ) Notice: Subject to any disclaimer, the term of this patent is extended or adjusted under 35 U.S.C. 154(b) by 106 days.

(21) Appl. No.: 12/460,937

(22) Filed: Jul. 27, 2009

(51) Int. Cl.
*C11D 11/00* (2006.01)

(52) U.S. Cl. ..... 510/182; 134/34; 134/37; 510/365; 510/405; 510/419

(58) Field of Classification Search ..... 134/34, 134/37; 510/180, 182, 365, 400, 405, 419, 510/528
See application file for complete search history.

(56) References Cited

U.S. PATENT DOCUMENTS

| | | | | |
|---|---|---|---|---|
| 2,079,793 | A * | 5/1937 | Donlan | 510/182 |
| 3,463,735 | A | 8/1969 | Stonebraker et al. | 252/137 |
| 3,728,269 | A | 4/1973 | Stephenson et al. | 510/407 |
| 3,819,522 | A | 6/1974 | Zmoda et al. | 252/89 |
| 3,979,317 | A | 9/1976 | Angelini | 252/170 |
| 4,054,534 | A | 10/1977 | Angelini | 252/158 |
| 5,814,590 | A * | 9/1998 | Sherry et al. | 510/237 |
| 6,271,191 | B1 * | 8/2001 | Kerobo et al. | 510/475 |
| 2002/0155969 | A1 * | 10/2002 | Rees et al. | 510/384 |

OTHER PUBLICATIONS

T.E. Furia; Handbook of Food Additives, 2nd Ed., vol. 1; 1968, CRC Press; pp. 594-595.*

* cited by examiner

*Primary Examiner* — Michael Kornakov
*Assistant Examiner* — Natasha Campbell

(57) ABSTRACT

A cleaning solution for fragile objects, such as chandeliers, and a multi-purpose cleaning solution, and methods of manufacture and use. The cleaning solutions comprise about 22% isopropyl alcohol, 0.2%-0.9% detergent, traces of volatile coloring and/or odorizing agents, and up to 100% distilled water to make 100%. As a chandelier cleaner, the solution is applied in two steps by dipping or spraying. The initial application loosens and/or dissolves any contaminants, and the second application causes them to flow away, leaving virtually no film or residue.

2 Claims, No Drawings

VOLATILE CLEANING SOLUTION FOR FRAGILE OBJECTS AND METHOD OF USE

CROSS REFERENCE TO RELATED APPLICATION

[Not Applicable]

STATEMENT REGARDING FEDERALLY SPONSORED RESEARCH OR DEVELOPMENT

[Not Applicable]

REFERENCE TO SEQUENCE LISTING, A TABLE, OR A COMPUTER PROGRAM LISTING COMPACT DISC APPENDIX

[Not Applicable]

BACKGROUND OF THE INVENTION

This invention relates to a spray-on, drip-off cleaning solution for cleaning fragile objects such as chandeliers and crystal fixtures, which is also useful as a multi-purpose "all in one" household cleaner which dries clean with little wiping.

The cleaning of chandeliers and similar decorative objects is often a delicate and time-consuming task because these objects are not only quite fragile, they are often very valuable, particularly if they are historic antiques or otherwise of museum quality. To clean each part by hand is a time-consuming and often dangerous task, because either the chandelier must be lowered to convenient working height, or the technician must work from a scaffold or powered "cherry picker" type of lifting device to reach the object to be cleaned.

Merely spraying the chandelier with water or detergent and letting it dry is not a satisfactory solution to the problem, because conventional cleaners either fail to loosen and remove the dirt and oily scum that tends to accumulate on chandeliers which have endured months or years in an often smoky or polluted environment, such as in hotel banquet halls and the like.

BRIEF SUMMARY OF THE INVENTION

It is therefore an object of this invention to provide a cleaning solution and method of use which is a true spray-on, drip-off type of cleaner which can be sprayed on a soiled chandelier and allowed to drip off, carrying all the dirt, oil and other contaminants with it, leaving only a volatile residue to evaporate with no further attention.

A further object of this invention is to provide such a cleaning solution and method of use in which the solution freely drips off of fragile surfaces and dries leaving little or no residue.

Yet another object of this invention is to provide a cleaning solution for general purposes which may be easily sprayed on and wiped off, without leaving a residue or stain. A related object is to provide such a cleaning solution of 100 percent volatility.

These and other objects of the instant invention are accomplished generally by providing a cleaning composition comprising a mixture of the following ingredients: about 22% Isopropyl alcohol (99% concentration), about 0.2%-0.9% detergent, coloring agents (traces) to give the solution a pleasant appearance, and with the balance of up to 80% distilled water, to make 100%, together with a specific method of use particular to the cleaning of delicate and valuable chandeliers.

BRIEF DESCRIPTION OF THE SEVERAL VIEWS OF THE DRAWING

[Not Applicable]

DETAILED DESCRIPTION OF THE INVENTION

The Preferred Composition (Chandelier Cleaner)

The cleaning solution of the chandelier cleaner embodiment of the present invention preferably contains:

21.8% Isopropyl alcohol (99% concentration)
0.2% detergent
78% Distilled water
Coloring agent (up to 4.50 ml per 13 gallon batch—see below)

The preferred detergents for this embodiment are: DAWN® dishwashing detergent, a product of The Procter & Gamble Company, 5299 Spring Grove Avenue, Cincinnati, Ohio 45217-1087; and FABULOSO®, a product of COLGATE-PALMOLIVE COMPANY, Commercial Customer Group, 191 East Hanover Avenue, Morristown N.J. 07960-3151. To each thirteen gallon batch, 1.75 oz of each of these products is added, for a total of 3.35 oz.

The preferred coloring agents are food dyes, as packaged by McCormick & Co. of Hunt Valley Md. For the chandelier cleaner, the colors of choice are blue (FD&C Blue #1—1.75 ml per batch) and red (FD&C Red #40—2.75 ml per batch), to give the product a light purple color. Up to 4.50 ml of these coloring agents has been found sufficient to adequately color a 13 gallon batch (49.2 liters) of finished chandelier cleaner solution without adversely affecting its spray-on, drip-off qualities, being not more than about 90 parts per million of the finished product.

The Preferred Method of Use (Chandelier Cleaner)

The preferred method of use for the chandelier cleaner involves a two-step process. First, the technician sprays the entire chandelier or other fragile object with the specified cleaning solution from top to bottom, being careful to uniformly wet all surfaces. The operator then waits approximately 3-10 minutes (depending on the temperature and humidity level in the room), allowing it to freely drip off.

The operator then re-applies the cleaning solution a second time, before the first application has dried and again allows it to freely drip off and evaporate, until the chandelier or other object is dry and free of residue.

This two-step process accomplishes several important things. The first application allows the cleaning solution to loosen the dirt and impurities on the object's surface and to partially remove them. The second application serves to remove the first (now spent) application of cleaning solution, flowing freely off the object and taking any remaining impurities.

The only remaining task for the technician is to check all surfaces to be sure they have been reached by the cleaning solution, and to re-apply locally as necessary. If there are bobeches (the dish-like accessories encircling the base of a candlestick for collection of wax drippings) they must be cleared of any remaining liquid by hand or compressed air.

Detailed Method of Use (Chandelier Cleaner)

Pursuant to the method of the invention, in cleaning chandeliers and similar glass and/or glass-like plastic fixtures, the technician desirably follows the following steps:

1) Ensures that the fixture has all electricity turned off, either at the wall switch or at the breaker box. If using the wall switch, it is best to actually tape the switch in the "Off" position as a reminder while cleaning is in progress.

2) Protect the area below the fixture being cleaned by laying absorbent materials in the area which the solution will drain off.

3) Ensure that all light bulbs in the fixture are now cool to the touch and securely and tightly screwed in to their sockets.

4) If there are candlestick covers made from other than plastic material, they should be covered with suitable protective sleeves or covers before applying the cleaning solution.

5) The technician commences by starting to spray the cleaning solution at the top of the fixture, ensuring that all surfaces are covered with a liberal amount of cleaning solution. The technician then works his/her way down, spraying in a like fashion, to the bottom of the fixture.

6) After the fixture has been thoroughly covered with a first application of cleaning solution, the technician waits, preferably for more than three minutes, but less than ten, being careful not to permit the first application of solution to completely dry.

7) The fixture is then re-sprayed with a second application of solution starting at the top and working down. Again, the solution is applied in a liberal amount and the technician again ensures that all surfaces are thoroughly coated.

8) The fixture is then permitted to dry.

If there are bobeches, they are wiped out and dried individually by hand, using a lint-free cloth, or a gentle application of compressed air. Using the cleaning solution of the present invention, the fixtures will dry clean and spot-free in between 20 and 30 minutes, depending on ambient temperature and humidity.

Once dried, the technician removes the candlestick cover protectors, if used. The light bulbs may also be cleaned at this time by spraying a small amount of cleaning solution on a lint free cloth or similar material and wiping each bulb by hand. When all the bulbs have been checked for security, and all their sockets have been checked to ensure that they are dry, the electric power can be restored to the fixture.

The desired outcome of this procedure is as follows. The first application of cleaning solution dislodges and otherwise loosens the dirt/impurities from the surfaces to be cleaned. Then the second spray application of cleaning solution has the effect of washing off the first, now-spent spent application, leaving the surfaces clean and streak free, but still wet. When allowed to dry normally, the fixture will be free of dirt and impurities, and will be sparkling clean with no oily film or other residue.

For unusually large fixtures, the technician may choose to work in sections, depending on the size and placement of the fixture elements, but otherwise the procedure is the same.

Cleaning of most chandeliers and similar fixtures should generally take place on a six month cycle. Certain climates and locations may present increased cleaning cycle needs, such as, for example, coastal areas where salt air is present. Accelerated and shortened scheduling times are also required in construction areas where there may by excessive airborne particles, or banquet halls where tobacco smoke may have left unsightly residues.

For optimal performance, certain precautions should be observed in using the cleaning solution of the present invention.

First, the optimum ambient temperature range for use this product is 65-85 degrees F. At temperatures above this range, the cleaning solution will evaporate too quickly before it has completed cleaning the fixture. At temperatures below this range, the cleaning solution may not dry off fast enough. While the fixture will still benefit from some cleaning effect, the end result will not be optimum in temperatures other than the above-mentioned preferred range of temperature.

Second, the optimum ambient humidity levels for use of the product range from 30-45 percent. At humidity levels above this range, the cleaning solution may not evaporate/dry quickly enough, resulting in streaking of the cleaned surfaces. Again, while the fixture may benefit from some cleaning effect, the end result will not be optimum.

Third, best results are achieved if the fixture is not cleaned while in direct sunlight. Direct sunlight promotes premature evaporation of the cleaning solution, often resulting in streaking.

The Preferred Composition (Multi-Purpose Cleaner)

As a multi-purpose cleaner, the solution preferably contains:

21.6% Isopropyl alcohol (99% concentration)

0.9% detergents 77.5% Distilled water

Coloring agent (about 2.55 ml per 13 gallon batch—see below)

The preferred detergents for this embodiment are the same as for the chandelier cleaner.

The preferred coloring agents are also food dyes, as packaged by McCormick & Co. of Hunt Valley Md. For the multi-purpose cleaner, the colors of choice are (FD&C Green #3—1.75 ml per batch) and yellow (FD& C Yellow #5—0.80 ml per batch) to give the product a light green color. Up to 2.55 ml of these coloring agents has been found sufficient to adequately color a 13 gallon batch (49.2 liters) of finished general purpose cleaner solution without adversely affecting its spray-on, wipe-off qualities, again being not more than about 90 parts per million of the finished product.

Because this cleaner contains no paraffin or ammonia, it provides a streak-free shine on most hard surfaces. Also, it possesses a sanitizing quality. What is unique about this cleaning solution when used as a general purpose cleaner is its versatility. It is equally effective and easy to use in cleaning windows, glass, counter tops, mirrors, granite, stainless steel, toilet seats, car windows, porcelain, glassware, crystal, ceramic tile and all similar hard and/or polished surfaces. And like its chandelier cleaner counterpart, it has been found to dry virtually streak free. It also sanitizes as it cleans.

It has also been found that as a multi-purpose cleaner, the solution of the present invention need only be applied in small quantities, making it very economical.

The Preferred Method of Use (Multi-Purpose Cleaner)

The preferred method of using the cleaning solution of the present invention as a multi-purpose cleaner is as follows:

1) The product is liberally sprayed on the surface to be clean, preferably in a fine mist, thus assuring complete coverage consistent with economical usage. Best results are attained by using the cleaner on surfaces which are cool to the touch. Spraying the cleaner on heated surfaces will cause the cleaner to evaporate before it can be wiped off. Best results are therefore attained by using the product on areas with surface temperatures below 110 F. Humidity levels above 70% will result in excessive wiping/drying in order to completely dry the area. While the surface will still realize the cleaning effect, the end result will not produce optimum performance.

2) The cleaner is allowed to rest on the surface for not more than 30 seconds to one minute, and then wiped off using a dry, lint free cloth or like material.

As with the chandelier cleaning solution, better results are realized if the product is not used in direct sunlight. If properly applied, once the cleaner is wiped from the surface, it will dry free of streaks and other residue.

It has been found that used as a multi-purpose cleaner in the manner described, that the surface need be cleaned only once, compared with other products for a similar purpose which may require multiple applications.

The Method of Manufacture (Both Cleaners)

The improved cleaning solutions of the present invention are manufactured following the following steps. It should be noted that the order in which the components are mixed is important.

First, the ingredients and the mixing container should ideally be within the temperature range of 65-85 degrees F. (Ambient humidity levels have not been found to be a factor.)

Second, the detergents and coloring agents are combined in a separate container and set aside.

Third, the required amount of distilled water is added to the mixing container.

Fourth, the detergent-coloring agent mixture is added to the mixing container and mixed thoroughly. This sequence is followed in order to avoid creating foam during the mixing procedure.

Fifth, when the detergent/color-distilled water mixture is thoroughly mixed, the alcohol component is added to bring the total of all ingredients to 100%, and the resulting mixture mixed again, taking care not to create foaming.

It has been found that it is particularly important not to add the alcohol component until the detergent/color-distilled water mixture is thoroughly mixed. Not observing this precaution can result in coagulation of the coloring elements, resulting in color solids precipitating out of the mixture.

The mixture is then permitted to rest and cool, because temperature of the solution will have been raised by the latent heat created and released by the mixing of the water and alcohol. The bottling process must not be commenced until the solution has cooled to ambient temperature. Failure to observe this precaution may result in the product having an undesirable cloudy appearance, as opposed to a clean, clear appearance. The cooling time required for typical thirteen gallon batches of the product has been found to range from 8 to 15 minutes.

Bottling of the solution can now take place. After bottling, adverse storage temperatures (heat/cold) as found in normal commercial and household storage situations have not been found to adversely affect either product.

Pertinent MSDS Information (Both Cleaners)

Ingredients:

Purified Water CAS#: 7732-18-5

Isopropyl Alcohol CAS#: 67-63-0

Physical/Chemical Characteristics:

Boiling Point=205 degrees F.

Freezing Point=−20 deg C.

Vapor Density (AIR=1)=2.0

Specific Gravity=0.977 @ 60 deg C.

Solubility in water=100%

Flash Point: 116 deg F. ASTM D92, 1990

Auto Ignition Temperature: 685 deg F.

Flammable limits in air, % by volume: Lower: 2.5 Upper: 12.0

Contents appearance: Light green color (chandelier cleaner); Light purple color (general purpose cleaner)

I claim as my invention:

1. The method of manufacturing a cleaning solution consisting of a mixture of about 22% Isopropyl alcohol (99% concentration), 0.2% detergent, about 78% distilled water to make 100%, and not more than 90 parts per million of coloring agent, comprising the steps of Bringing the ingredients and a mixing container to a temperature in the range of 65-85 degrees F.;

Combining and mixing the detergent and the coloring agents in a separate container;

Adding the specified amount of distilled water to the mixing container;

Adding the mixed detergent and coloring agents to the water in the mixing container and thoroughly mixing said ingredients;

Adding and mixing the alcohol to the mixing container and thoroughly mixing all the combined ingredients again, without foaming; and Letting the mixture cool to ambient temperature before bottling.

2. The method of manufacturing a cleaning solution of claim 1 in which the coloring agents are selected from the group consisting of FD&C Green #3, FD&C Yellow #5, FD&C Red #40, and FC&C Blue #1.

* * * * *